US008510942B2

(12) United States Patent
Wakade et al.

(10) Patent No.: US 8,510,942 B2
(45) Date of Patent: Aug. 20, 2013

(54) CAMSHAFT LOBE AND METHOD OF MAKING SAME

(75) Inventors: Shekhar G. Wakade, Grand Blanc, MI (US); Frederick J. Rozario, Fenton, MI (US); Glenn E. Clever, Washington, MI (US); Joseph E. Robbins, Mayville, MI (US); Stephen R. Kornblum, Walled Lake, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1140 days.

(21) Appl. No.: 12/247,287

(22) Filed: Oct. 8, 2008

(65) Prior Publication Data

US 2010/0083498 A1 Apr. 8, 2010

(51) Int. Cl.
*B21D 53/84* (2006.01)

(52) U.S. Cl.
USPC ..... 29/888.1; 419/48; 419/52

(58) Field of Classification Search
USPC ..... 29/888.1, 423, 424; 419/1, 29, 38, 419/66, 48, 52; 148/103, 104
See application file for complete search history.

(56) References Cited

U.S. PATENT DOCUMENTS

| | | | | |
|---|---|---|---|---|
| 3,535,169 | A | 10/1970 | Caubet et al. | |
| 4,524,046 | A | 6/1985 | Suganuma et al. | |
| 5,405,574 | A | 4/1995 | Chelluri et al. | |
| 5,611,139 | A | 3/1997 | Chelluri et al. | |
| 5,611,230 | A | 3/1997 | Chelluri et al. | |
| 5,689,797 | A | 11/1997 | Chelluri et al. | |
| 5,715,780 | A | 2/1998 | Haller | |
| 6,136,265 | A | 10/2000 | Gay | |
| 6,524,526 | B2 | 2/2003 | Barber | |
| 7,455,509 | B2 * | 11/2008 | Knoth et al. | 425/78 |
| 7,574,995 | B2 | 8/2009 | Graham | |
| 7,744,812 | B2 * | 6/2010 | Witherspoon et al. | 419/66 |
| 8,133,329 | B2 * | 3/2012 | Wakade | 148/104 |
| 2009/0282675 | A1 * | 11/2009 | Rozario et al. | 29/888.4 |

(Continued)

FOREIGN PATENT DOCUMENTS

| | | | |
|---|---|---|---|
| CN | 2425728 | Y | 4/2001 |
| DE | 3907886 | A1 | 3/1989 |
| JP | 60043405 | A * | 3/1985 |

OTHER PUBLICATIONS

English Abstract of JP 60043405A, Masayuki, Mar. 1985.*

(Continued)

*Primary Examiner* — David Bryant
*Assistant Examiner* — Ryan J Walters
(74) *Attorney, Agent, or Firm* — Dinsmore & Shohl LLP

(57) ABSTRACT

An automotive engine component and method of producing the same. The method uses dynamic magnetic compaction to form components, such as camshaft lobes, with non-axisymmetric and related irregular shapes. A die is used that has an interior profile that is substantially similar to the non-axisymmetric exterior of the component to be formed such that first and second materials can be placed into the die prior to compaction. The first material is in powder form and can be placed in the die to make up a first portion of the component being formed, while a second material can be placed in the die to make up a second portion of the component. The second material, which may possess different tribological properties from those of the first material, can be arranged in the die so that upon formation, at least a portion of the component's non-axisymmetric exterior profile is shaped by or includes the second material.

17 Claims, 4 Drawing Sheets

(56) References Cited

U.S. PATENT DOCUMENTS

| | | | | |
|---|---|---|---|---|
| 2009/0317653 | A1* | 12/2009 | Wakade et al. | 428/548 |
| 2010/0189587 | A1* | 7/2010 | Wakade et al. | 419/66 |
| 2011/0097233 | A1* | 4/2011 | Wakade | 419/38 |

OTHER PUBLICATIONS

Chinese Office Action dated Jul. 3, 2012 pertaining to U.S. Appl. No. 12/247,287, filed Oct. 8, 2008.

Pinglei Qian, "Communication Crossed in Various Directions", May 1, 2005, U.S. Appl. No. ISBN7-5439-2577-X/U.001, pp. 4-5, Chinese with English translation attached.

Chinese Office Action dated Jul. 16, 2012 pertaining to U.S. Appl. No. 12/604,074, filed Oct. 22, 2009.

Office Action dated Jun. 14, 2011 pertaining to U.S. Appl. No. 12/359,391, filed Jan. 26, 2009.

Office Action dated Nov. 28, 2011 pertaining to U.S. Appl. No. 12/359,391, filed Jan. 26, 2009.

Office Action dated Mar. 9, 2012 pertaining to U.S. Appl. No. 12/604,074, filed Oct. 22, 2009.

Office Action dated Sep. 7, 2012 pertaining to U.S. Appl. No. 12/604,074, filed Oct. 22, 2009.

Harry E. Chandler, "Optimizing P/M Part Machining", ASM International, Maching of Powder Metallurgy Materials, pp. 1-8.

German Office Action dated Feb. 7, 2013 for DE 10 2009 043 382.1 which pertains to U.S. Appl. No. 12/247,287, filed Oct. 8, 2008.

* cited by examiner

CAMSHAFT LOBE AND METHOD OF MAKING SAME

BACKGROUND OF THE INVENTION

The present invention relates generally to the manufacture of automotive engine components possessing non-round exterior shapes using a powder metallurgy process, and more particularly to the manufacture of camshaft lobes using a modified dynamic magnetic compaction (DMC) process.

Automotive engine camshaft lobes must endure significant and repeated mechanical loading under high-speed, high-temperature and tribologically-varying conditions. The use of conventional manufacturing processes, such as casting, forging or the like, tends to produce components which, while satisfactory from a load-bearing perspective, result in heavy, inefficient structures. Likewise, the use of conventional manufacturing approaches is not conducive to tailoring a particular material's desirable properties to discreet locations on a camshaft lobe. Furthermore, the use of DMC, which is taught in U.S. Pat. Nos. 5,405,574, 5,611,139, 5,611,230 and 5,689,797 (all of which are hereby incorporated by reference), while a valuable way to compact both metallic and non-metallic powders to achieve high-density components, has not hitherto been extended to camshaft lobes, gears or other non-axisymmetric (i.e., non-cylindrical) or otherwise irregularly-shaped components.

Camshaft lobes and other highly-loaded engine components could benefit from the strategic placement of materials into the lobe that can be tailored to the lobe operating environment. For example, surface portions (for example, the generally planar eccentric surfaces) of the lobe that are exposed to higher loads may benefit from harder or other more load-bearing materials that would not be needed in the generally axisymmetric portion of the lobe. Likewise, such materials could be used in the DMC process to give a particular shape to a formed component. Because such more robust materials may involve greater expense, weight or detrimental features, they may only be used sparingly. As such, it would be advantageous to develop ways to combine the efficient manufacturing attributes of DMC with the tailored structural properties of disparate constituent materials to fabricate structurally efficient components.

BRIEF SUMMARY OF THE INVENTION

These advantages can be achieved by the present invention, wherein improved engine components and methods of making such components are disclosed. According to a first aspect of the invention, a method of fabricating an automotive engine component using DMC is disclosed. Under the present method, an exterior profile of the component can be made non-axisymmetric (i.e., such that its external shape deviates from a cylindrical form). The method includes providing a die or related tool with an interior profile that is substantially similar to the exterior profile of the component being formed. Furthermore, a first material in powder form is placed within a first part of the die interior profile such that the first material defines at least a first portion of the component being formed. In addition, the method includes placing within a second part of the die interior profile a second material, and then forming the automotive engine component using dynamic magnetic compaction to compact or otherwise densify the two materials together. In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

In one form, the second material is placed within the region that defines the non-axisymmetric exterior profile, while the first material is placed in the region that defines the axisymmetric exterior profile, non-axisymmetric profile or both. In a more specific form, the first powder can be used to form a majority of the component, with the second material being placed in a location such that upon formation of the component, the second material occupies a portion of the surface of the component that can be expected to be exposed to increased load, wear or related mechanical requirements. In one optional form, the method further includes making the automotive component into a camshaft lobe. In another option, the second material comprises a second powder, which in a more particular optional form, may possess different wear, friction or related tribological properties from the powder of the first material. In an even more particular form, the second powder is harder or otherwise more wear-resistant than the first powder. In another option, at least one of the first and second powders are selected from the group consisting of metal powders, ceramic powders and a combination of both.

In another option, instead of a powder, the second material may be in the form of a substantially rigid insert. Such insert may be made from a different material from the alloy used to make up the remainder of the component. In one form, the different material may be a hardenable steel alloy, ceramic material or other long-wearing, high load-bearing composition. Such an insert defines a profile such that can be placed over at least a portion of the first material such that the second material forms an outer surface of a part of the component that is expected to be exposed to higher levels of load, wear, friction or the like. For example, in situations where the component includes an eccentricity or related non-axisymmetric shape and such non-axisymmetric shape corresponds to the part of the component in need of additional structural properties, the second material can be placed in such a way that it makes up at least a majority of the non-axisymmetric exterior profile, or takes a majority of the loading when the load is at a maximum. The substantially rigid insert may be made from either a reusable or non-reusable. In the case of the latter, the insert may remain with the formed component upon completion of the compaction. In the case of the former, such as when being used to shape the outer profile of the component of interest, the insert does not remain with the automotive engine component upon the fabrication such that it may be re-used. In one configuration, during the forming process, the one or more substantially rigid insert cooperates with one or more reusable inserts such that an outer shape of the component is defined by such cooperation. In a more particular form, numerous such reusable segments can be placed within a die so that their inner surfaces compact the first and second materials in response to the DMC process. In this way, the reusable segments can press the non-reusable segments into place in a particular location in the component to be formed.

According to another aspect of the invention, a method of fabricating a camshaft lobe is disclosed. The method includes providing a die with an interior profile that substantially defines an exterior surface of the lobe, placing a first material within a first part of the interior profile of the die, placing a second material within a second part of the interior profile of the die such that the second material is used to form at least a portion of the exterior surface of the lobe that corresponds to the lobe eccentricity, and forming the lobe using dynamic magnetic compaction. As with the previous aspect, one significant advantage over the prior art DMC process is that non-axisymmetric and related irregular component shapes can be formed.

Optionally, the second material occupies a majority of the exterior surface of the lobe that corresponds to the lobe eccentricity. In this way, the use of materials with tribologically superior properties can be tailored to corresponding surface regions of the lobe. This can be an advantageous way of supplementing the tribological or related structural properties of heavily-loaded parts of the lobe, such as its eccentric region, where conventional DMC may not be capable of producing a part with the necessary structural attributes. In another option, at least one of the first and second materials is made of a powder that can be compacted via the DMC process. In a further option, the second material can be made from a different composition than the first material. In this way, metal alloys, ceramic precursors or related materials can be strategically placed on portions of the exterior surface of the lobe to tailor the material properties to the load-bearing needs of the lobe. In yet another option, the second material is made from a substantially rigid non-reusable insert that may be operated upon by a reusable insert. The interior profile of the die used to form the lobe may be made up of reusable inserts that cooperate with the one or more non-reusable inserts so that the second material that makes up the non-reusable insert is pressed together with the first material. In this way, the lobe is formed as a substantially unitary structure that can be further processed.

According to yet another aspect of the invention, a camshaft lobe for an internal combustion engine is disclosed. The lobe can be made by the DMC process discussed in the previous aspects, and includes a camshaft-engagable interior surface made up of a first material and an exterior surface made up of one or more eccentric portions at least a portion of which is formed by a second material. In this way, the interior surface defines an axial bore thought the lobe.

Optionally, the first material is made from different than the second material. In a more specific option, both the first and second materials comprises a powder such that each is tailored to particular portions of the lobe. In another option, the second material can be made from a substantially rigid insert selected from the group consisting of reusable inserts and non-reusable inserts. In the case of re-usable inserts, the second material is used to form a portion of the finished lobe, but does not remain with it. In the case of non-reusable inserts, the second material, by virtue of the DMC process, is formed into at least a portion of the lobe exterior surface and remains with it. In this way, the second material can (in the case of a re-usable insert) help to define the shape during DMC or (in the case of a non-reusable insert) be used to actually occupy a portion of the lobe exterior surface once co-formed with the first material during DMC.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENTS

Figure 1C:
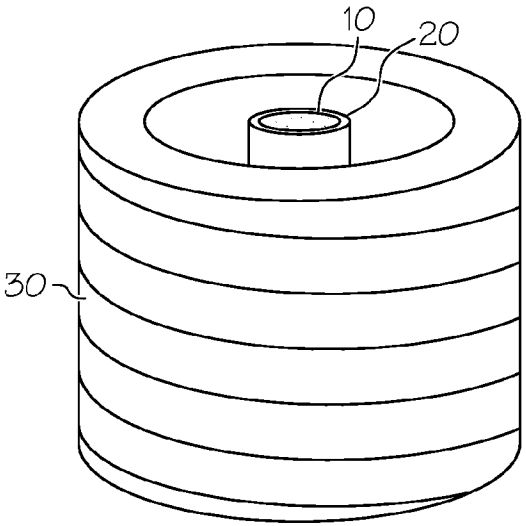
FIG. 1C (PRIOR ART)
FIGS. 1A through 1C shows a the various steps used in the DMC process of the prior art for making a cylindrical-shaped powder component.
Figure 1B:
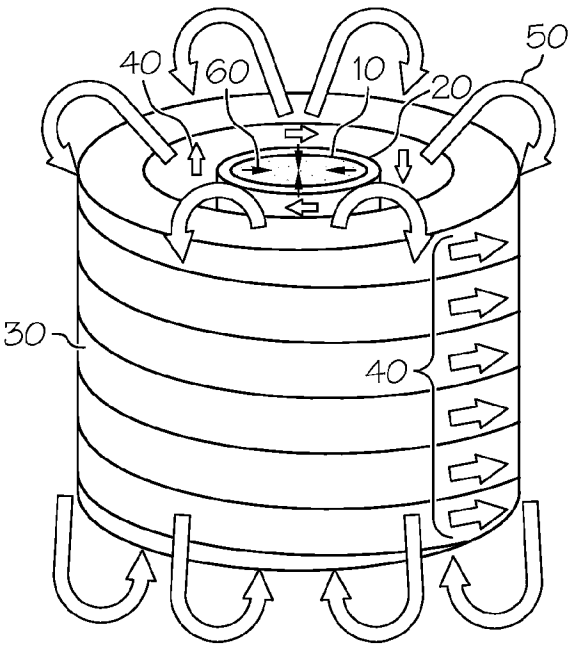
FIG. 1B (PRIOR ART)
Figure 1A:
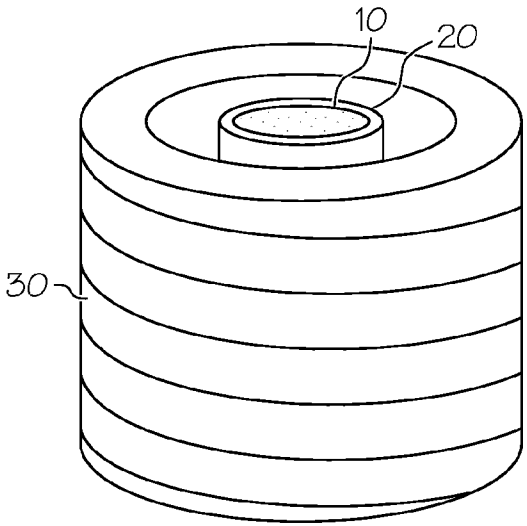
FIG. 1A (PRIOR ART)

Referring initially to FIGS. 1A through 1C, the DMC process according to the prior art is shown, where a generally cylindrical-shaped component is produced. FIG. 1A shows a powder material 10 placed within an electrically conductive cylindrical armature 20. A coil 30 is connected to a direct current power supply (not shown) such that electric current can be passed through the coil 30. The powder material 10 substantially fills the electrically conductive armature 20 (also called a sleeve). Referring with particularity to FIG. 1B, a large quantity of electrical current 40 is made to flow through the coil 30; this current induces a magnetic field 50 in a normal direction that in turn sets up magnetic pressure pulse 60 that is applied to the electrically conductive container 20. This radially inward pressure acts to compress the container 20, causing the powder material 10 to become compacted and densified into a full density parts in a very brief amount of time (for example, less than one second) and at relatively low temperatures. In addition, this operation can (if necessary) be performed in a controlled environment to avoid contaminating the consolidated material. By way of example, the current flow through the coil 30 may be in the order of 100,000 amperes at a voltage of about 4,000 volts, although it will be appreciated that other values of current and voltage may be employed, depending on the characteristics of the container 20 and the powder material 10 inside. Referring with particularity to FIG. 1C, once the DMC process is complete, the armature 20 and powder material 10 are shown compressed, occupying a smaller transverse dimension than previous size of FIG. 1A.

Figure 2:
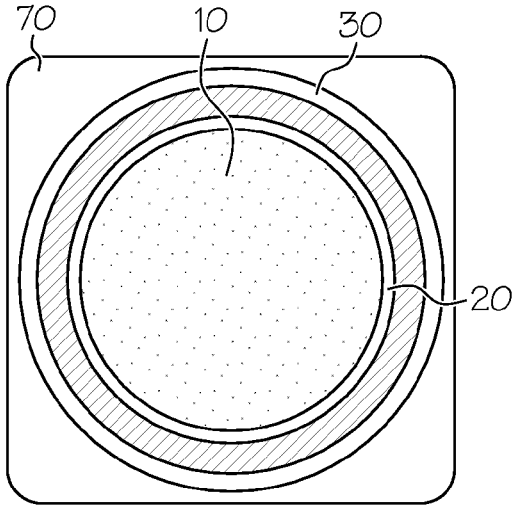
FIG. 2 (PRIOR ART)
FIG. 2 shows a top-down view of a cylindrical part and the various parts used to form such part using a conventional DMC process of the prior art.

Referring next to FIG. 2, a top-down view of a notional cylindrical DMC containment structure according to the prior art is shown. A loosely held powder 10 is placed in an electrically conductive round container 20. The sudden passage of a large amount of current through the coil 30 produces a magnetic field, which in turn induces a current in the container 20. This induced current produces a second magnetic field which, by its magnitude and direction, repels the first magnetic field. This mutual repulsion causes container 20 to be compressed, which in turn applies pressure on the powder 10, causing its compaction. A top-down view of a notional cylindrical DMC containment structure is shown. Coil 30 is placed inside an external containment shell 70 to restrain the coil 30 against radially-outward expansion when repelled by the second magnetic field.

Figure 3:
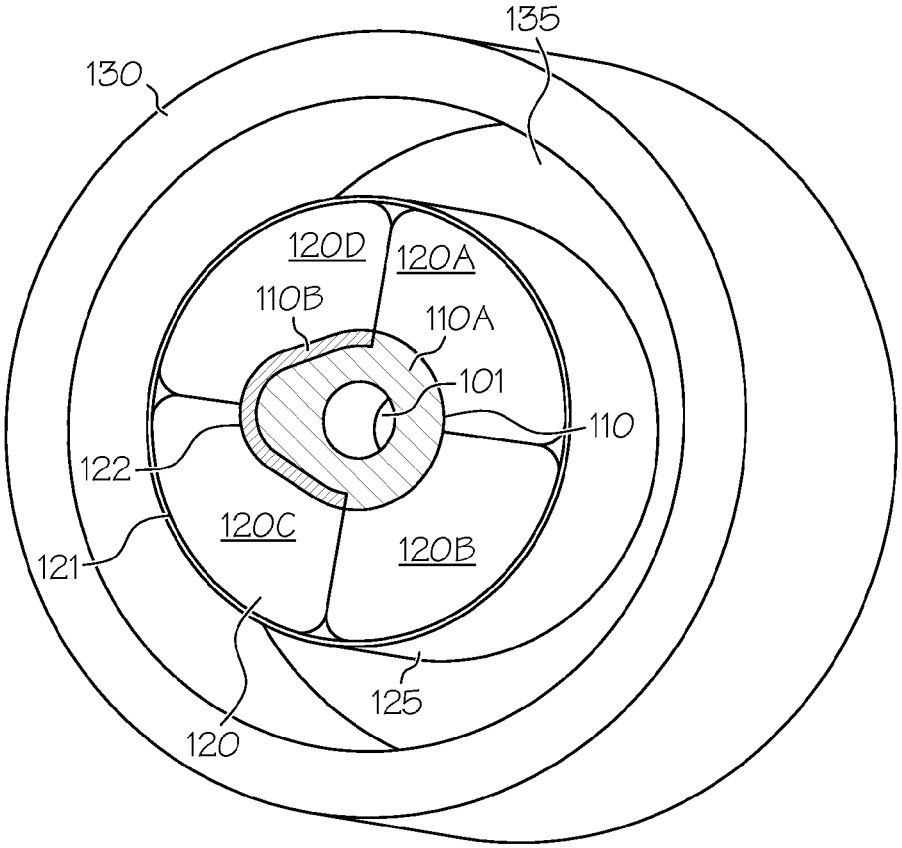
FIG. 3 shows a cutaway view of a camshaft lobe and associated tooling of the modified DMC process according to an aspect of the present invention.
Figure 4:
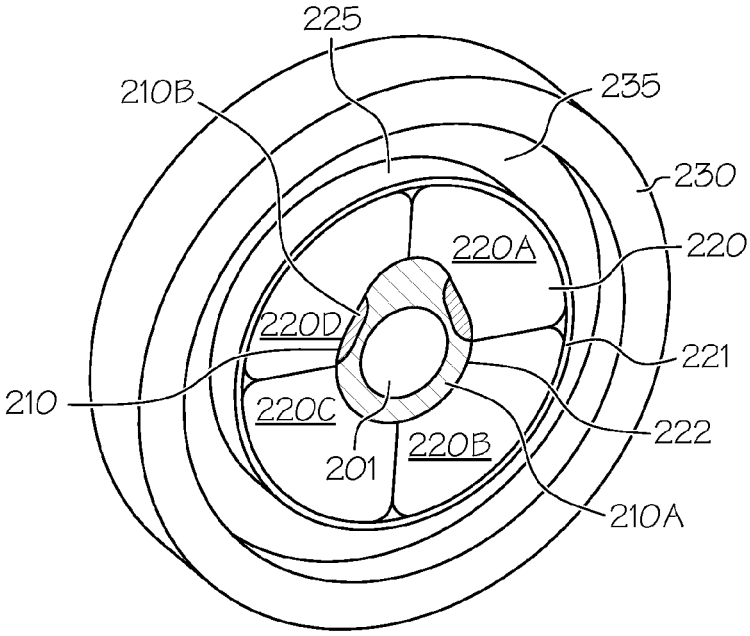
FIG. 4 shows a cutaway view of a camshaft lobe and associated tooling of the modified DMC process according to another aspect of the present invention.

Referring next to FIGS. 3 and 4, camshaft lobes 110 (FIG. 3) and 210 (FIG. 4) are shown, as well as the tooling used to form them. The use of non-axisymmetric tooling results in a modified DMC process in that the axisymmetric limits of the traditional DMC process have been overcome. Referring with particularity to FIG. 3, an electrically-conducting coil 130 is wound around a sleeve 125 that is placed between the coil 130 and die 120. As shown, a gap (for example, and air gap) 135 is situated between coil 130 and sleeve 125. As with conventional DMC, the present DMC-based process exploits the electric current flowing through coil 130 in order to impart a magnetically-compressive force onto the sleeve 125, die 120 and the precursor materials within. The die 120 is generally axisymmetrically-shaped around its outer surface 121, while its inner surface 122 is similar to the desired outer shape of the lobe 110 being formed. The die 120 is formed from four reusable segments 120A, 120B, 120C and 120D, where the portion of the inner surface 122 that is used to form the axisymmetric part of the lobe 110 corresponds to die segments 120A and 120B and the portion of the inner surface 122 that is used to form the non-axisymmetric eccentric part of the lobe 110 corresponds to die segments 120C and 120D. A central bore 101 can be formed in the lobe 110 through the inclusion of an appropriately-shaped mandrel (not shown) during the lobe-forming process. Sleeve 125 is compressed by the magnetic forces generated by coil 130, as is die 120; this in turn causes the precursor materials to be deformed by the compressive forces to compact the precursor powder materials. This results in formation of a "green" or un-sintered lobe 110 that may undergo conventional sintering, machining and related finishing steps (none of which are shown).

As can be seen in the figure, lobe 110 has at least two distinct portions 110A and 110B. The first portion 110A forms a base circle portion of lobe 110 and is preferably made from a material such as an alloy steel powder possessive of mechanical properties suitable for camshaft lobe applications. In addition to occupying the substantial entirety of the axisymmetric portion of the lobe 110, the first portion 110A can form the underlying (i.e., interior) surface of the non-axisymmetric part, and a first material can be used to define or otherwise occupy this first portion 111A. By contrast, a second material can be used for the second portion 110B where additional structural (including tribological) properties may be desired. Unlike the first portion 111A, the second portion 110B is preferably limited to parts of the lobe 110 that require the enhanced properties associated with the second material. As with the first material, the second material may be a metal powder specifically formulated to meet the specific needs for an application where the lobe surface would experience at least one of rolling loads, sliding loads or a combination thereof. In one example, the powder may be made from a ferrous alloy with chemical composition formulated in a way so as to improve wear resistance, friction reduction or the like of the second material. Because the second material is tailored to meet particular performance needs, and is typically at least one of more expensive, heavier or more difficult to fabricate with, it should be used sparingly. As such, it may be advantageous to only have it occupy as much surface area of lobe 110 as necessary. By having this structurally-enhanced second material occupy the outer surface of portion 110B of lobe 110, it can, with subsequent compaction with the first material of the first portion 110A by DMC, form lobe 110 into a substantially unitary structure with composite properties: a low-cost, lightweight, readily manufacturable first portion 110A and a durable, tribologically-enhanced second portion 110B.

Referring with particularity to FIG. 4, lobe 210 can be formed by the operation of the die 220, coil 230 and sleeve 225. Lobe 210 can define a slightly different shape than that of lobe 110, including a reduced use of a second material in first portion 210A in a region that makes room for an insert in the form of second portion 210B. Unlike the lobe 110 of FIG. 3, the first portion 210A may have an exposed outer surface in the non-axisymmetric portion of the lobe 210. As with the lobe 110 of FIG. 3, a first material may be used to occupy the first portion 210A. Also, as with the lobe 110, lobe 210 includes discrete locations on the outer surface of the second portion 210B where a second material insert can be used to enhance local structural properties. Also as with the device of FIG. 3, the die 220 with inner and outer surfaces 222, 221 can be segmented into reusable segments 220A, 220B, 220C and 220D and include the shaped cutouts on the inner surface 222 thereof to promote ease of component assembly. Also as with the configuration depicted in FIG. 3, a gap 235 may be formed between the coil 230 and the die 220.

Unlike the assembly of FIG. 3, the second material used for the second portion 210B of lobe 210 is in the form of an insert that cooperates with the first material such that upon compaction by the DMC process, forms indentations into the lobe 210 that define the second portion 210B. In one form, the second portion insert 210B can be a material (for example, in powder form) that has tribologically different properties than the material making up the first portion 210A of lobe 210. Together, the inserts made up of lobe inserts 210B and die 220 (including its segments 220A, 220B, 220C and 220D) take on one of two forms. In the first form, inserts in the form of die segments 220A, 220B, 220C and 220D are reusable, while in the second, the inserts 210B are non-reusable in that they become a part of the finished lobe 210, and the two forms can cooperate with one another to form lobe 210. Die segments 220A and 220D are placed such that upon compaction, the non-reusable inserts fill the indents that are formed in the outer surface of the second portion 210B of lobe 210 that, in addition to being used to help create a desired lobe profile, remain with the lobe 210 upon completion of the compaction process, thereby forming an integral part of the outer surface thereof by occupying the second portion 210B. As such, it is designed to couple with the powder first material precursor to form a composite lobe 210 in a manner generally similar to that of lobe 110. Placement of the non-reusable insert (made of, for example, the second material) into the precursor may be simpler than in the case of lobe 110, where both the first and second materials are in powder form. To facilitate the process (where a dual powder filling operation is employed), a temporary screen (not shown) may be used to keep fill powders in the desired regions until compaction. Appropriate heat treatment may be performed on the compacted lobes. As with the previous aspect of lobe 110, once DMC has been completed, various additional sintering, machining and related finishing steps may be undertaken.

Figure 5:
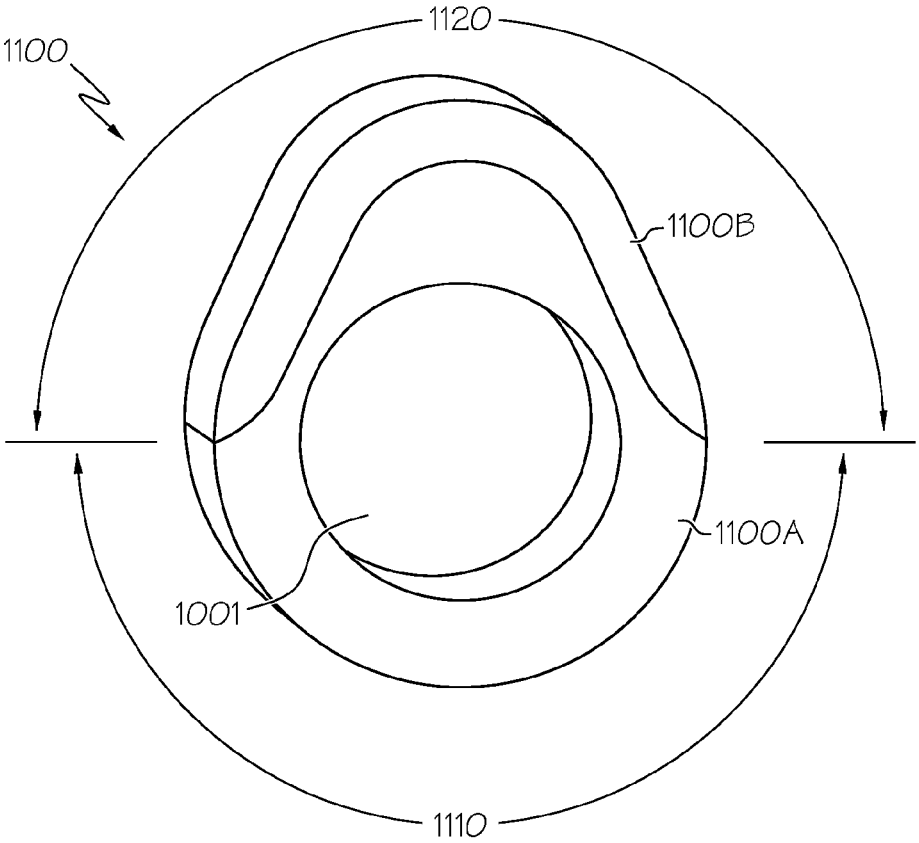
FIG. 5 shows a camshaft lobe as produced by the tooling of FIG. 3.
Figure 6:
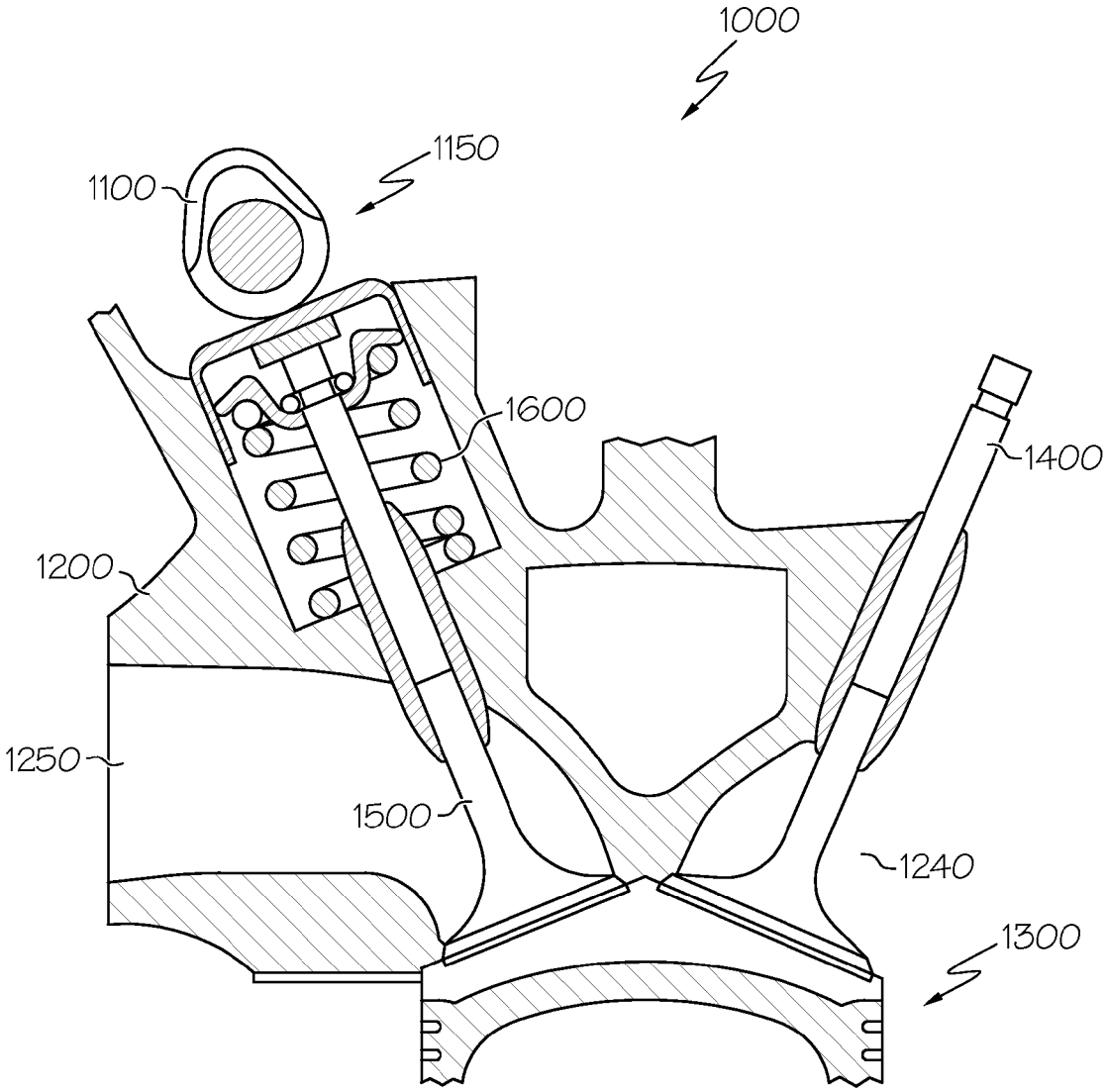
FIG. 6 shows a partial cutaway view of an automotive engine with a camshaft employing one or more lobes made by the modified DMC process of the present invention.

Referring next to FIGS. 5 and 6, an as-manufactured lobe 1100 and incorporation into a camshaft 1150 and automotive engine 1000 is shown. Referring with particularity to FIG. 5, the two portions 1100A and 1100B of lobe 1100 are shown co-formed by the DMC process. As will be understood from the above discussion, first portion 1110A is generally made up of the first material that occupies the substantial entirety of the axisymmetric part 1110. Second portion 1110B is generally made up of the structurally-enhanced second material that occupies the substantial entirety of the non-axisymmetric part 1120. The central bore 1001 that is used to connect the lobe 1100 to a camshaft 1150 (shown in FIG. 6) may be of any appropriate size.

Referring with particularity to FIG. 6, portions of the top of an automotive engine 1000 incorporating a lobe 1100 and accompanying camshaft 1150 is shown for a notional direct-acting tappet design. A piston 1300 reciprocates within a cylinder in the engine block (not shown). A cylinder head 1200 includes intake ports 1240 and exhaust ports 1250 with corresponding intake and exhaust valves 1400, 1500 to convey the incoming air and spent combustion byproducts, respectively that are produced by a combustion process taking place between the piston 1300 and a spark plug (not shown) in the cylinder. Camshaft 1150 is driven from an external source, such as a crankshaft (not shown), and includes a cam lobe 1100 that defines a non-axisymmetric profile about the longitudinal axis of the camshaft 1150. Upon camshaft 1150 rotation about its longitudinal axis, the eccentric portion of the lobe 1100 selectively overcomes a bias in valve spring 1600 to force exhaust valve 1500 at the appropriate time. It will be appreciated that similar structure is included for the intake valve 1400, but is removed from the present drawing for clarity. The lobe 1100 of the present invention includes selective reinforcement in the eccentric portion as discussed above to promote enhanced durability and performance. It will be appreciated by those skilled in the art that the valve train architecture shown associated with engine 1000, which includes a direct-acting tappet, is merely representative, and that camshaft lobes manufactured using the modified DMC process as described herein are equally applicable to other valve train architectures (not shown).

While certain representative embodiments and details have been shown for purposes of illustrating the invention, it will be apparent to those skilled in the art that various changes may be made without departing from the scope of the invention, which is defined in the appended claims.

What is claimed is:

1. A method of fabricating an automotive engine component using dynamic magnetic compaction such that, upon formation, said component defines an exterior profile having axisymmetric and non-axisymmetric portions, said method comprising:

providing a die having (i) a first part that defines a portion of an interior profile substantially similar to said axisymmetric exterior profile portion of said component; and (ii) a second part that defines a portion of an interior profile substantially similar to said non-axisymmetric exterior profile portion of said component;

placing, within said first part of said die, a first material in powder form such that, when subjected to dynamic magnetic compaction, said first material defines at least a portion of said component corresponding to said axisymmetric exterior profile portion;

placing, within said second part of said die, a second material such that, when subjected to dynamic magnetic compaction, said second material defines at least a portion of said component corresponding to said non-axisymmetric exterior profile portion; and forming said component from said first material and said second material using dynamic magnetic compaction;

wherein said formed component is a substantially unitary structure defining an exterior profile having axisymmetric and non-axisymmetric portions.

2. The method of claim 1, wherein said component comprises a camshaft lobe.

3. The method of claim 1, wherein said second material comprises a powder.

4. The method of claim 3, wherein said powder of said second material comprises different tribological properties from said powder of said first material.

5. The method of claim 4, wherein said second material has higher wear properties relative to said first material.

6. The method of claim 3, wherein at least one of said first and second materials are selected from the group consisting of metal powders, ceramic powders and a combination of both.

7. The method of claim 1, wherein said second material comprises at least one substantially rigid insert.

8. The method of claim 7, wherein said at least one substantially rigid insert defines a profile such that, when subjected to said dynamic magnetic compaction along with said first material, defines at least a majority of said non-axisymmetric exterior profile.

9. The method of claim 8, wherein said at least one substantially rigid insert comprises a non-reusable insert that remains with said component upon completion of said dynamic magnetic compaction.

10. The method of claim 7, wherein during said forming, said at least one substantially rigid insert cooperates with at least one reusable insert that does not remain with said component such that an outer shape of said component is defined by said cooperation.

11. The method of claim 10, wherein said at least one reusable comprises a plurality of segmented inserts that when placed within a die cooperate therewith to compact said first and second materials in response to said dynamic magnetic compaction.

12. A method of fabricating a camshaft lobe, said method comprising:

providing a die having (i) a first part that defines a portion of an interior profile substantially similar to an axisymmetric exterior surface portion of said lobe; and (ii) a second part that defines a portion of an interior profile substantially similar to a non-axisymmetric exterior surface portion of said lobe;

placing a first material within said first part of said die such that said first material, when subjected to dynamic magnetic compaction, defines at least a portion of said axisymmetric exterior surface portion of said lobe;

placing a second material within said second part of said die such that said second material, when subjected to dynamic magnetic compaction, defines at least a portion of said non-axisymmetric exterior surface portion of said lobe; and forming said lobe from said first and second material using dynamic magnetic compaction;

wherein said formed lobe is a substantially unitary structure with an exterior surface having axisymmetric and non-axisymmetric portions.

13. The method of claim 12, wherein said second material occupies a majority of said exterior surface of said lobe that corresponds to the lobe eccentricity.

14. The method of claim 12, wherein at least one of said first and second materials comprises a powder.

15. The method of claim 14, wherein said second material is of a different composition than said first material.

16. The method of claim 14, wherein said second material comprises at least one substantially rigid insert.

17. The method of claim 16, wherein said interior profile of said die is defined by a plurality of reusable inserts that cooperate with said at least one substantially rigid insert to press said second material thereof into said first material such that said lobe is formed as a substantially unitary structure.

* * * * *